US005769010A

United States Patent [19]

Orbeck

[11] Patent Number: 5,769,010

[45] Date of Patent: Jun. 23, 1998

[54] FURNACE INCLUDING LOCALIZED INCINERATION OF EFFLUENTS

[75] Inventor: Gary A. Orbeck, Windham, N.H.

[73] Assignee: BTU International, Inc., North Billerica, Mass.

[21] Appl. No.: 565,448

[22] Filed: Feb. 1, 1996

[51] Int. Cl.[6] ..... F23J 11/00

[52] U.S. Cl. ..... 110/345; 110/250; 110/242; 110/211

[58] Field of Search ..... 110/242, 250, 110/210, 211, 345

[56] References Cited

U.S. PATENT DOCUMENTS

| | | | |
|---|---|---|---|
| 2,580,235 | 12/1951 | Lellep . | |
| 3,271,015 | 9/1966 | Mahony . | |
| 3,653,645 | 4/1972 | Heian . | |
| 3,732,062 | 5/1973 | Porteus . | |
| 3,774,555 | 11/1973 | Turner . | |
| 3,868,211 | 2/1975 | Haye et al. . | |
| 3,881,874 | 5/1975 | Shular et al. . | |
| 3,909,189 | 9/1975 | Ban . | |
| 3,920,380 | 11/1975 | Heian . | |
| 3,937,154 | 2/1976 | Hughes . | |
| 3,953,190 | 4/1976 | Lange . | |
| 4,002,534 | 1/1977 | Rammler et al. . | |
| 4,038,154 | 7/1977 | Barnebey . | |
| 4,069,008 | 1/1978 | Bloom . | |
| 4,125,380 | 11/1978 | Negola . | |
| 4,236,887 | 12/1980 | Heian . | |
| 4,240,787 | 12/1980 | Jamaluddin . | |
| 4,242,084 | 12/1980 | Jamaluddin . | |
| 4,251,207 | 2/1981 | Beck et al. . | |
| 4,322,203 | 3/1982 | Jamaluddin . | |
| 4,367,065 | 1/1983 | Cnare . | |
| 4,434,004 | 2/1984 | Ratschat . | |
| 4,438,705 | 3/1984 | Basic . | |
| 4,439,141 | 3/1984 | Deckebach . | |
| 4,516,510 | 5/1985 | Basic . | |
| 4,606,722 | 8/1986 | Olauson . | |
| 4,635,568 | 1/1987 | Angelo . | |
| 4,817,539 | 4/1989 | Korkia . | |
| 4,890,563 | 1/1990 | White et al. . | |
| 4,913,065 | 4/1990 | Hemsath . | |
| 4,917,023 | 4/1990 | Jones | 110/211 X |
| 4,923,391 | 5/1990 | Gitman . | |
| 5,012,751 | 5/1991 | Kirlin . | |
| 5,050,579 | 9/1991 | Melton et al. | 110/211 X |
| 5,558,029 | 9/1996 | Peake | 110/210 |
| 5,579,704 | 12/1996 | Mansur | 110/250 X |

*Primary Examiner*—Henry A. Bennett
*Assistant Examiner*—Susanne C. Tinker
*Attorney, Agent, or Firm*—Weingarten, Schurgin, Gagnebin & Hayes LLP

[57] ABSTRACT

A furnace includes a high temperature heating source located within the cavity of the furnace which incinerates undesired effluents produced during the normal thermal processing of material. The heating source comprises one or more hot wires disposed within apertured tubes, which are at a temperature above the ignition point of the undesired effluents. As the effluents pass into the tube through the apertures, they are incinerated, thereby producing an exhaust that is generally pollution free. Additionally, the heat used during the incinerating of the undesired effluents fully provides the heating requirements of the furnace for the thermal processing of material.

15 Claims, 2 Drawing Sheets

FURNACE INCLUDING LOCALIZED INCINERATION OF EFFLUENTS

FIELD OF THE INVENTION

The invention relates generally to furnaces, and more particularly to the incineration of undesired effluents given off by products processed within the furnace.

BACKGROUND OF THE INVENTION

The thermal processing of product within a furnace, such as the curing of epoxies or cements, can result in outgassing of undesired effluents or volatiles from the product into the atmosphere within the furnace. The effluents produced by the thermal processing of the product must themselves be processed before being released to the atmosphere. One manner of processing the undesired effluents is to incinerate them, while another manner of processing the undesired effluents is to condense and collect them. Either way of processing the unwanted effluents requires a large amount of energy since the effluents must be brought to a very high temperature for incineration or brought to a very low temperature for condensation and collection. Additionally, incineration of undesired effluents is generally done in separate combustion chambers or afterburners. However, this manner requires the addition of a separate housing for the combustion chamber or afterburner, the delivery of the effluents from the furnace to the combustion chamber or afterburner via a conduit of some type, and the provision of additional energy required by the combustion chamber or afterburner for incineration.

SUMMARY OF THE INVENTION

The present invention relates to a furnace for thermally processing products which give off undesired effluents or volatiles. The furnace includes a heating source which is used for thermal processing the products and for the incineration of undesired effluents which result from thermal processing of the products within the furnace. The heating source comprises a hot wire disposed within an apertured tube, which is at a temperature above the ignition point of the undesired effluents. As the effluents pass into the tube through the apertures, they are incinerated, thereby producing an exhaust that is generally pollution free. The heat required to incinerate the undesired effluents is also used to provide heat to the furnace for the thermal processing of product, thereby using the normal furnace power to provide a second function of incineration within the system.

BRIEF DESCRIPTION OF THE DRAWINGS

The invention will be more fully understood from the following detailed description taken in conjunction with the accompanying drawings in which.

DETAILED DESCRIPTION

Figure 1:
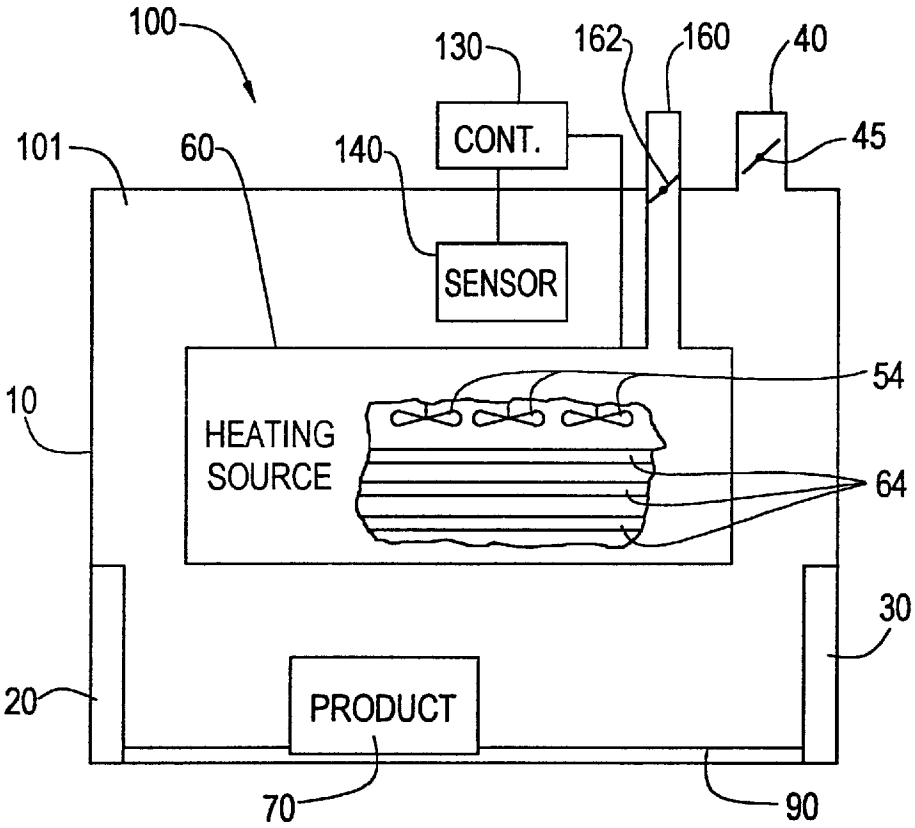
FIG. 1 is a partially broken away schematic illustration of a furnace including a heating source for incineration of undesired effluents according to the invention.

FIG. 1 shows a convection furnace 100 according to the present invention for thermally processing product 70 which may give off undesirable effluents or volatiles. Typically, the furnace 100 includes a support source 90, which frequently comprises a conveyor assembly, for transporting product 70 through the furnace chamber 101, and a heating source 60 for thermally processing the product 70. A recirculating device such as a fan or blower assembly 54 is provided to recirculate the furnace atmosphere through the heating source. A vent 40 is provided to exhaust the furnace atmosphere outside the furnace housing 10. A control-valve 45 controls the venting of the furnace atmosphere outside the furnace 100. The high-temperature heating source 60 serves to incinerate the undesired effluents produced by the thermal processing of the product 70 and also provides normal furnace requirements.

More specifically, the support assembly 90 is used to transport product from a furnace inlet 20 into heat transfer proximity with the heating source 60 for a predetermined period of time, then to a furnace exit 30. The transport assembly can be a conveyor such as rollers, a conveyor belt or chain, a walking beam or any other known device for transporting product within a furnace.

In an alternate embodiment the support assembly may be stationary within the housing and the product 70 to be thermally processed placed into the furnace through a furnace opening such as furnace inlet 20. Such placement can be by means external to the furnace or can be manual. After the thermal processing and incineration of undesired effluents has taken place, the product 70 is removed from the furnace via furnace inlet 20.

A fan assembly 54, or other gas moving device, provides air flow across the elements of the heater, resulting in a flow of heated air exiting first heating source 60 directed toward the product 70. As the product 70 is heated by the heating source 60, the product gives off undesired effluents. The heating source 60 may comprise any suitable number and configuration of heaters and heater units.

Figure 3:
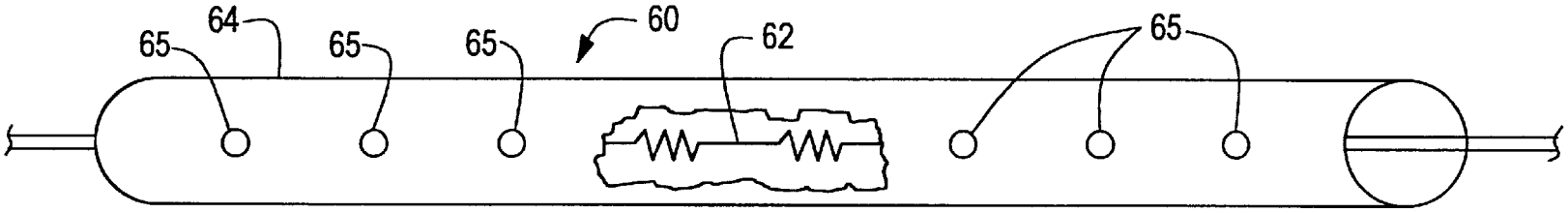
FIG. 3 is a partially broken away schematic illustration of a heating source according to the invention.

The heating source 60 provides heat at a temperature above the ignition point of the undesired effluents which are present within furnace atmosphere 100 as a result of the thermal processing of product 70. The heating source 60 can be an open flame, hot wire or other type of heating source. In a preferred embodiment, the heating source 60 comprises a thin wire 62 disposed in a tube 64 having apertures 65 arranged along the length of the tube 64 (FIG. 3). The heating source 60 is located within the furnace cavity in a position perpendicular to a portion of the gas circulation flow path in the furnace. In this manner a portion of the circulating gas passes around the tube 64 and some of the gas enters the tube 64 through the apertures 65 and comes into heat transfer proximity with the hot wire 62. The heating source 60 provides heat at, for example, approximately 700° C., which is above the ignition temperature of most hydrocarbons. The incineration of the hydrocarbons results in carbon monoxide and water.

Heating source 60 provides heat at a temperature above the ignition point of the effluents that are in the atmosphere of the furnace cavity 101. As a result of heating source 60 providing heat at a temperature above the ignition point of the effluents, the undesired effluents are incinerated thereby removing them or greatly reducing the presence of them. Consequently, the exhaust produced is generally pollution free, with all or substantially all of the undesired effluents removed therefrom. The after product of this incineration can then be more safely vented into the atmosphere through vent 40 and/or more easily processed. Alternately, heating source 60 can have its own vent 160 which includes control-valve 162, for exhaust of the incineration byproducts outside the furnace housing 10. The thermally processed product 70 can then be removed from furnace 100 via outlet 30.

For example, the products 70 being thermally processed may be automotive brake shoes. An epoxy is used to secure brake pads onto the automotive brake shoes. In this instance the epoxy requires curing at 300° C. in order to securely attach the brake pads onto the brake shoes. During the curing of the epoxy, undesired volatiles or effluents, in this instance hydrocarbons, driven from the epoxy and into the atmosphere of the furnace 100. Environmental concerns and regulations require that the amount of hydrocarbons released into the atmosphere be below a certain level. In order to safely vent the atmosphere outside the furnace, the undesired effluents must be either reduced or removed.

The heating source 60 is constantly enabled and is regulated by a controlling device 130 so that heating source 60 is employed for normal furnace power. The controlling device 130 may also be in communication with a sensor 140 which detects the presence and amounts of effluents, as would be known in the art. The controlling device 130 activates the heating source 60 when the heat is called for. The sensor 140 may also be used to control a secondary incinerator (not shown) or to slow the support assembly in order to get the hydrocarbon levels reduced.

Figure 2:
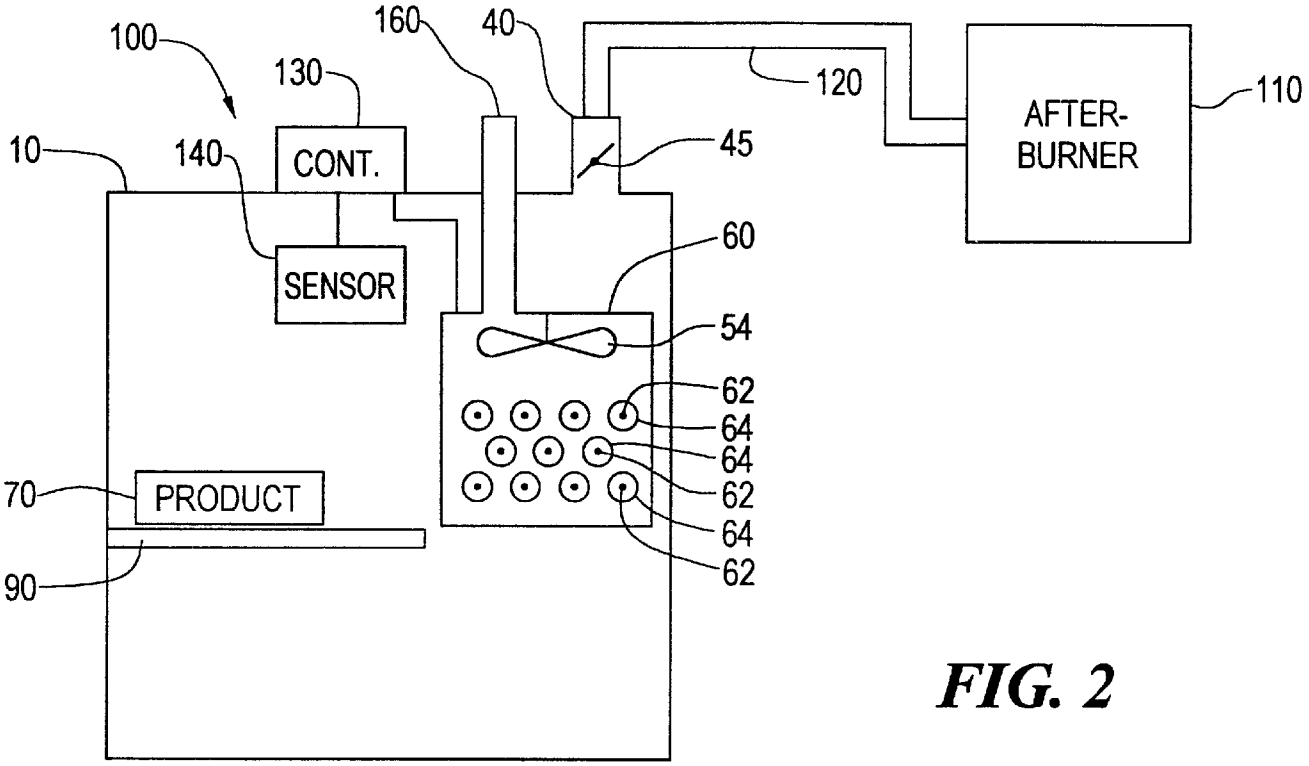
FIG. 2 is a cross-sectional schematic illustration of the furnace of FIG. 1 further including an external afterburner.

In some instances the atmosphere within the furnace housing 10 has an amount of effluents which can be reduced but not completely eliminated by the heating source 60. To address this instance, the embodiment of FIG. 2 is employed wherein an afterburner 110 is physically located outside the furnace 100, and is coupled to the furnace 100 by conduit 120. The exhaust resulting from the incineration within the furnace 100 is then vented to the afterburner 110 through vent 40 via control-valve 45 and conduit 120 for complete incineration or further reduction of the remaining effluents. In such an embodiment as this, the workload of the afterburner 110 is reduced since the heating source 60 of furnace 100 has removed a percentage of the effluents from the furnace atmosphere.

Having described preferred embodiments of the invention it will now become apparent to those of ordinary skill in the art that other embodiments incorporating these concepts may be used. Accordingly, it is submitted that the invention should not be limited to the described embodiments but rather should be limited only by the spirit and scope of the appended claims.

We claim:

1. An incinerating furnace comprising:

a furnace chamber housing;

an inlet in said furnace housing;

a vent extending from said furnace housing; and a heating source disposed within said furnace housing, to provide heat to a product for thermally processing a product and to incinerate at least a portion of effluents given off by the product during thermal processing, said heating source including a second vent.

2. The incinerating furnace of claim 1 further comprising:

an outlet in said furnace housing; and a transport assembly disposed within said furnace housing, from said inlet to said outlet.

3. The incinerating furnace of claim 1 further comprising an afterburner, said afterburner located externally to said furnace, said afterburner communicating with said furnace via said vent.

4. The incinerating furnace of claim 1 further comprising a controlling device in communication with said heating source.

5. The incinerating furnace of claim 4 further comprising an atmosphere sensor in said furnace housing in communication with said controlling device.

6. The incinerating furnace of claim 1 wherein said heating source comprises an open flame.

7. The incinerating furnace of claim 1 wherein said heating source provides heat at a temperature of approximately 700° C.

8. An incinerating furnace comprising:

a furnace chamber housing;

an inlet in said furnace housing;

a vent extending from said furnace housing; and a heating source disposed within said furnace housing, to provide heat to a product for thermally processing a product and to incinerate at least a portion of effluents given off by the product during thermal processing, wherein said heating source comprises at least one said at least one hot wire disposed within a respective at least one tube, said at least one tube including a plurality of apertures therein, said apertures disposed to allow effluents to come into heat transfer proximity with said at least one hot wire.

9. A method of incinerating effluents in a furnace having a housing, a heating cavity, an inlet in said housing, a heating source inside said heating cavity disposed to provide heat to the product, said heating source including a second vent, said heating source disposed along a gas circulation path within said cavity, and a first vent in said housing, comprising the steps of:

providing a product to be thermally processed;

thermally processing said product by bringing said product into heat transfer proximity with said heating source, said thermally processing of said product producing effluents;

incinerating at least a portion of the effluents by bringing the portion of the effluents into heat transfer proximity with said heating source; and removing an exhaust produced by said incinerating step outside the housing.

10. The method of claim 9 further including the steps of:

providing an outlet in said housing;

providing a transport assembly through said housing communicating with said inlet and said outlet; and transporting said product through said furnace along said transport assembly.

11. The method of claim 9 further including the step of:

regulating said heating source by a controlling device.

12. The method of claim 9 wherein the step of removing said exhaust further includes directing said exhaust to an afterburner.

13. The method of claim 9 wherein said heating source comprises an open flame.

14. The method of claim 9 wherein said incinerating step comprises heating said heating source to a temperature of approximately 700° C.

15. A method of incinerating effluents in a furnace having a housing, a heating cavity, an inlet in said housing, a heating source inside said heating cavity disposed to provide heat to the product, wherein said heating source comprises at least one hot wire, said at least one hot wire disposed within a respective at least one tube, said at least one tube including a plurality of apertures therein, said apertures allowing for effluents to come into heat transfer proximity with said at least one hot wire, said heating source disposed along a gas circulation path within said cavity, and a first vent in said housing, comprising the steps of:

providing a product to be thermally processed:

thermally processing said product by bringing said product into heat transfer proximity with said heating source, said thermally processing of said product producing effluents;

incinerating at least a portion of the effluents by bringing the portion of the effluents into heat transfer proximity with said heating source; and removing an exhaust produced by said incinerating step outside the housing.

* * * * *

UNITED STATES PATENT AND TRADEMARK OFFICE

CERTIFICATE OF CORRECTION

PATENT NO. : 5,769,010
DATED : June 23, 1998
INVENTOR(S) : Gary A. Orbeck

It is certified that error appears in the above-identified patent and that said Letters Patent is hereby corrected as shown below:

Column 4,
Line 17, reads "at least one said" should read -- at least one hot wire, said --

Signed and Sealed this

Fourteenth Day of August, 2001

*Attest:*

Nicholas P. Godici

*Attesting Officer*

NICHOLAS P. GODICI
*Acting Director of the United States Patent and Trademark Office*